US005269580A

United States Patent [19]

Hsiao

[11] Patent Number: 5,269,580

[45] Date of Patent: Dec. 14, 1993

[54] IN-LINE SKATE CARRIER

[76] Inventor: Louis Hsiao, 765 A Loma Verde Ave., Palo Alto, Calif. 94303

[21] Appl. No.: 960,945

[22] Filed: Oct. 14, 1992

[51] Int. Cl.[5] ..... B65D 71/00

[52] U.S. Cl. ..... 294/162; 294/165

[58] Field of Search ..... 294/141-143, 294/145, 146, 148, 159, 162-169; 12/120.5; 211/34, 37; 280/809, 811, 814

[56] References Cited

U.S. PATENT DOCUMENTS

| | | | |
|---|---|---|---|
| 2,353,809 | 7/1944 | Carson | 294/165 |
| 3,777,956 | 12/1973 | Jung | 294/163 |
| 3,909,718 | 9/1975 | Allsop et al. | 294/162 |
| 4,269,337 | 5/1981 | Sobotka | 294/163 |
| 4,277,006 | 7/1981 | Pinckard | 294/162 X |
| 4,279,366 | 7/1981 | Kessler et al. | 294/162 |
| 4,326,746 | 4/1982 | Grihalva | 294/162 X |
| 4,331,357 | 5/1982 | Contreras | 294/145 |
| 4,733,897 | 3/1988 | Schuetzeberg | 294/162 |

OTHER PUBLICATIONS

Canyon Products: Boot & Blade Totebag-date unknown, advertisement.

BNQ Accessories: Skate Hollerz-Jul. 1992, advertisement in "Speed Skating Times".

*Primary Examiner*—Johnny D. Cherry

*Attorney, Agent, or Firm*—Julian Caplan

[57] ABSTRACT

In-line skates comprise a boot, an inverted longitudinal channel secured to the sole of the boot and rollers rotatably mounted in the channels. The invention comprises a body having two laterally spaced pockets each having side supports dimensioned to engage opposite sides of the skate channel to hold the boots side-by-side and having a hook to hook around one of the rollers (preferably the forward-most roller). The forward ends of the pocket-forming portions are connected by a transverse member to which a carrying handle is attached. A retainer is resiliently attached to the body to apply pressure to the boots to prevent them from popping out of the pockets.

27 Claims, 5 Drawing Sheets

IN-LINE SKATE CARRIER

BACKGROUND OF THE INVENTION

1. Field of the Invention

This invention relates to a new and improved carrier for in-line skates.

2. Description of the Related Art

A problem of holding and carrying in-line skates has existed for some time but has not heretofore been effectively solved. One technique previously used is to carry the skates in a bag slung over the shoulder, but such means has no support to prevent the skates from scratching each other inside the bag. Another means previously used is a bag worn around the shoulder and waist, but such a device is bulky, awkward and aesthetically unappealing.

Still another device is a strap threaded through the skates slung over the shoulders. Such an arrangement strains the neck and shoulders of the wearer, and clothes may be soiled by contact with the skates if they are dirty.

Ski boots have been held and carried by various types of equipment, such as U.S. Pat. No. 4,733,897. The boot is inserted into clips and securely held in place. However, the means for attachment of ski boots and in-line skates must necessarily be different since the bottoms of ski boots are flat and the bottoms of rollers of such skates are inherently unstable.

SUMMARY OF INVENTION

In-line skates comprise a boot to the sole of which is affixed an inverted channel-shaped blade. Three or more roller wheels are rotatably mounted in-line partially within the channel-shaped member. Hence, when not being worn, the boot is inherently unstable in upright position.

The present invention comprises a carrier formed with two pockets for the front ends of two skates. The pockets are shaped to hold the boots upright. One end of each pocket is attached to a carrying handle. To hold the skate within the pocket, a resilient clasp in each pocket engages behind and partially over the top of one of the forward rollers and also under the bottom edge of the channel. Additionally, a retainer which is resiliently supported engages the forward end of the boot or channel to prevent the skate from popping out of the pocket.

A preferred clasp is of generally U-shape. The parallel ends of the clasp are anchored to the handle portion of the carrier and extend backward along either side of the pocket. The central portion of the U-shaped clasp is bent upward and positioned to extend around either side of one of the forward rollers and then cross to engage the top of the roller. Portions of the clasp also fit under the lower edge of the channel. Such a clasp has the advantage of accommodating different models of skates which vary in the dimensions of the rollers.

Another feature of the present invention is the use of a support stop which holds the boot in upright position as well as lateral supports which engage the channel, also assisting in holding the boot upright.

A further feature of the present invention is the positioning of the carrier handle in line with the center of gravity of the skates thereby reducing stress on the user in carrying the skates.

Still another feature of the present invention is the provision of means on the carrier which may function to fit over a wall-mounted hook or peg so that the skates may be hung off the floor.

Still another feature of the present invention is the provision of means on the carrier where auxiliary equipment used with in-line skates may be attached. Usually skaters wear knee pads, wrist guards, elbow guards, and helmets and also carry extra wheels, laces and various other pieces of equipment. The structure of the holder hereinafter described provides areas where such equipment may be suspended from the carrier when the skates are stored.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
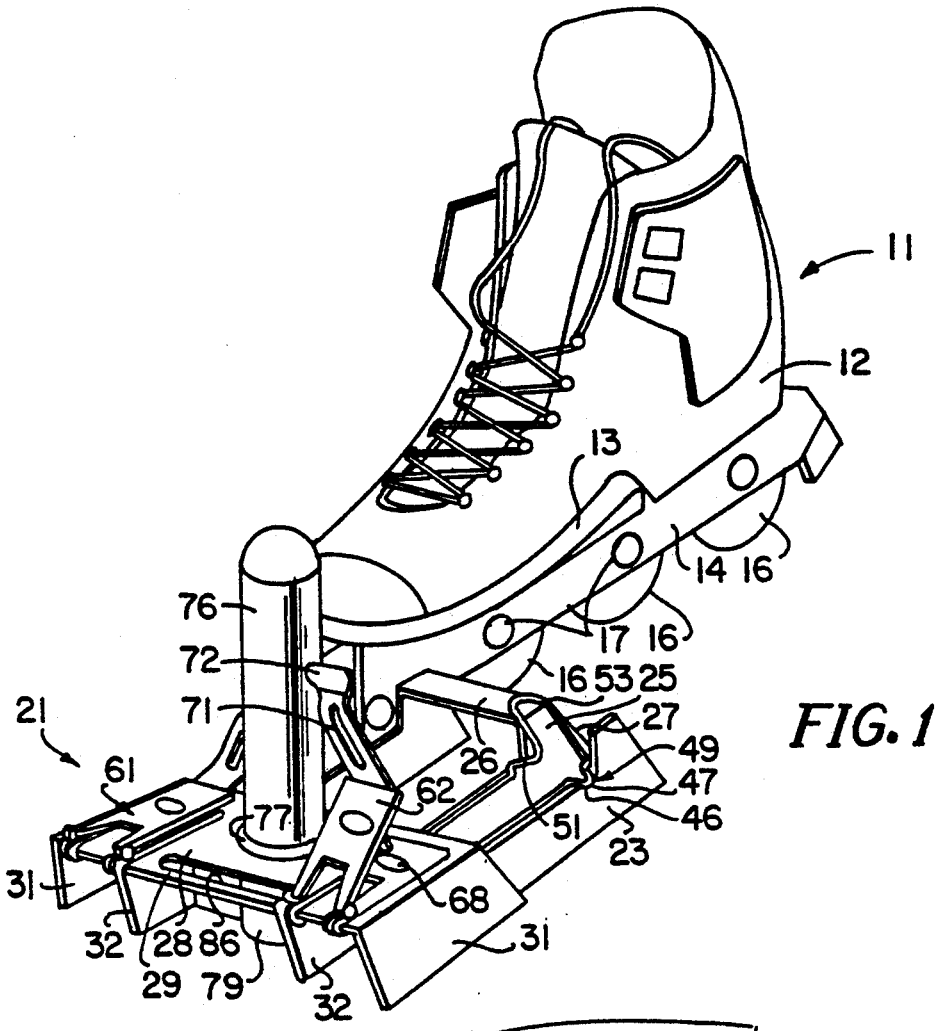
FIG. 1 is a perspective view of a carrier showing one skate supported in one of the pockets and the other pocket empty.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

In-line skate 11 is partially shown in the accompanying drawings. Such a skate has a boot 12 formed with a sole 13 to which is affixed an inverted-channel-shaped in-line frame 14. A plurality of rollers 16 (here shown as four in number) is supported in line within the channel 14 on axles 17. Only the lower portions of the rollers 16 extend below the level of the channel 14.

It is apparent that unless otherwise supported, the skate 11 is inherently unstable due to the elliptical form of the rollers. The carrier 21 of the present invention supports a pair of skates 11 upright.

Carrier 21 is provided with two pocket forming portions 22, one for each skate. Each pocket 22 comprises spaced vertical, longitudinally extending lateral supports 23 spaced apart a distance slightly greater than the width of the channel 14, the lower ends of the lateral supports 23 being joined by a transverse web 24. An upward extension 25 is formed at the rear edge of the inner lateral support 23 of each pocket 22 and the upper ends of the inner extensions 25 are joined by a transverse rear connector 26 which rigidifies the back end of the carrier.

Figure 5:
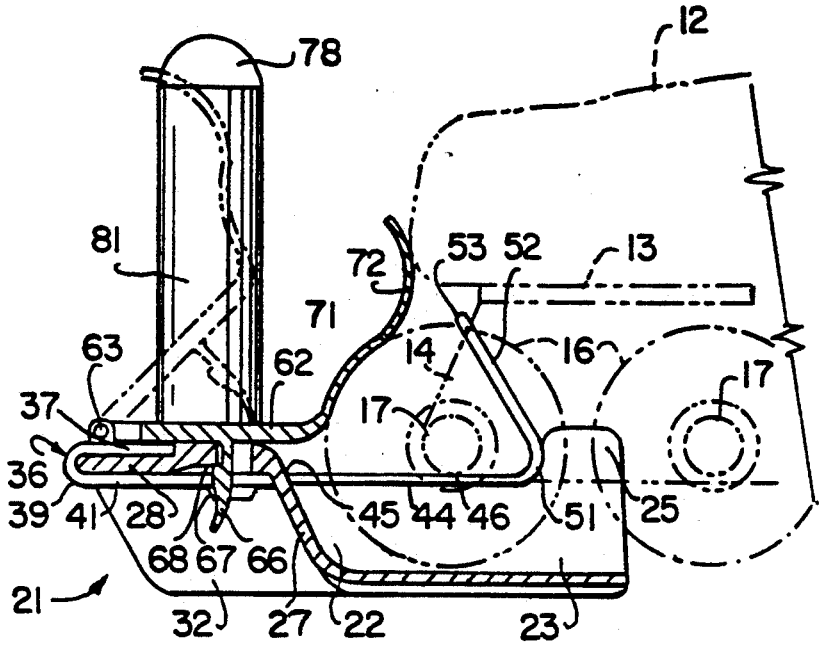
FIG. 5 is a sectional view taken substantially along the line 5—5 of FIG. 2.
Figure 6:
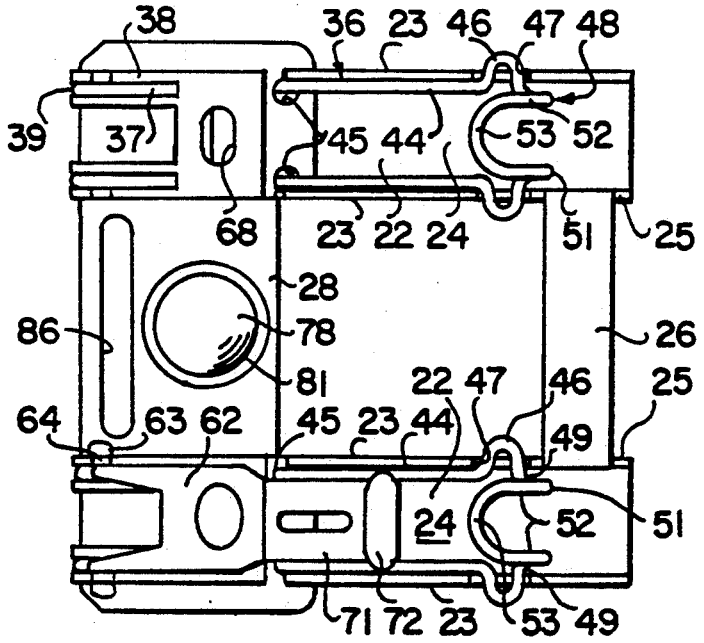
FIG. 6 is a top plan of the carrier with one of the retainers removed.
Figure 7:
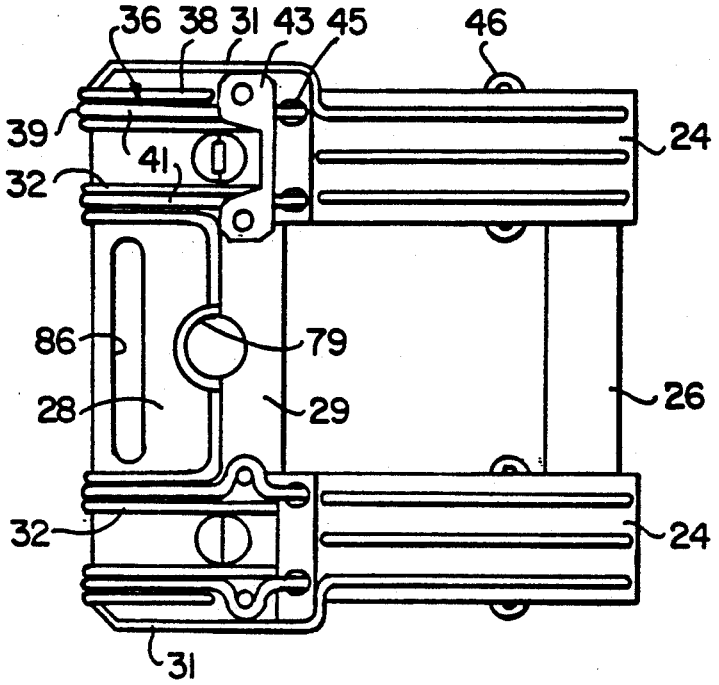
FIG. 7 is a bottom plan thereof.

Directing attention particularly to FIG. 5, the rear end of pocket 22 is open and the forward end of each pocket 22 is closed off by an upward-forward slanted forward end 26. The upper edge 27 of each forward end 26 merges into a horizontal transverse elevated platform 28. Transverse front connector 29 rigidifies the front ends of pockets 22. Downward extending outer legs 31 and inner legs 32 support platform 28 on the support surface on which it rests and extend downwardly from the outer edge of each elevated platform 28 to rest upon a supporting surface to hold the carrier upright.

Figure 2:
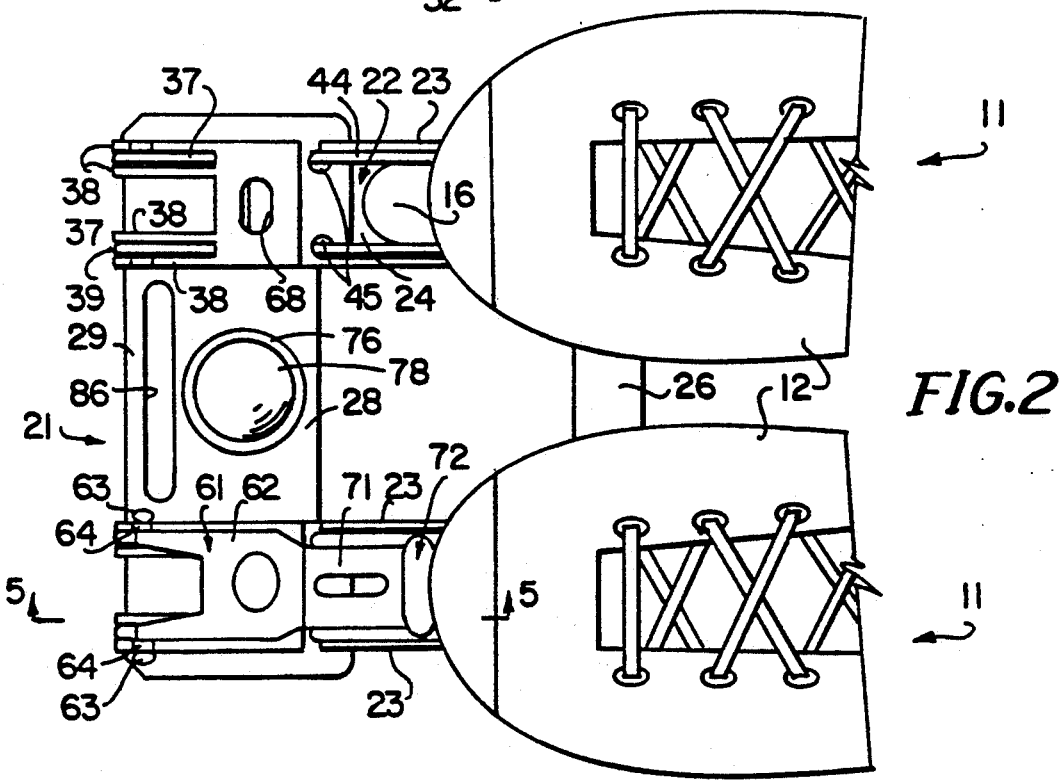
FIG. 2 is a partial plan view of the carrier.
Figure 3:
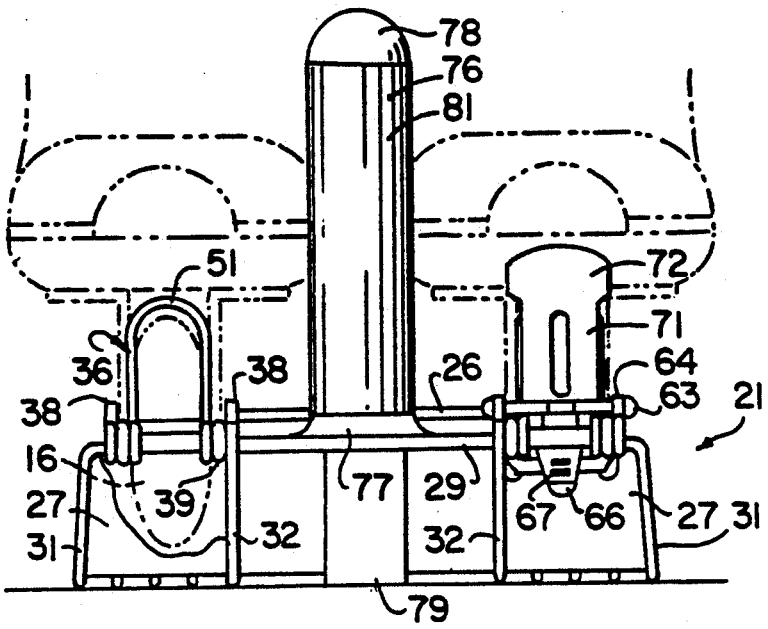
FIG. 3 is a front elevational view, partially broken away.
Figure 4:
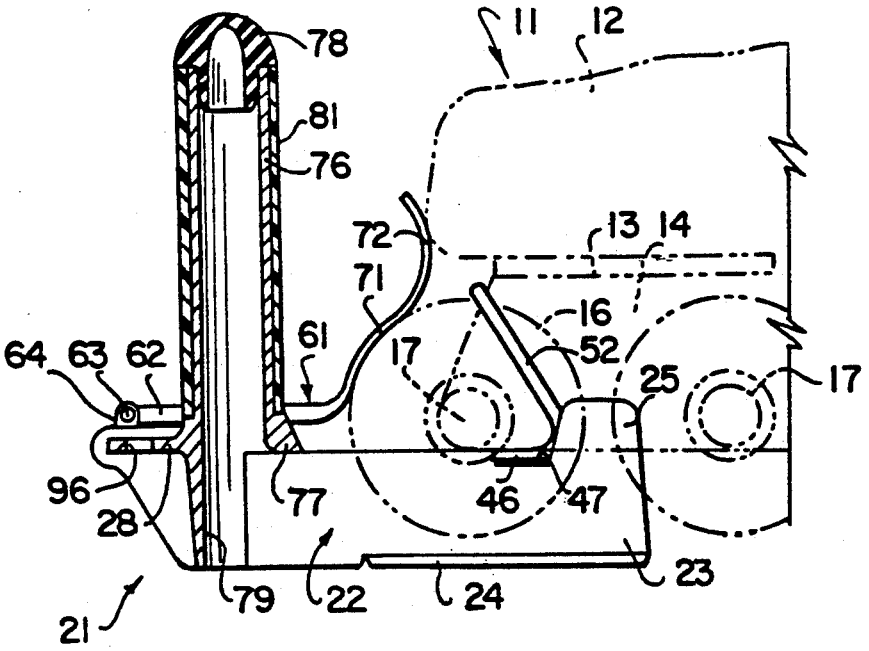
FIG. 4 is a side elevational view, partially broken away.

To hold one of the rollers 16 (here shown as the forward roller in each instance) within pocket 22, means is provided to engage around the back and over the top of such roller. Hence, for each pocket there is a clasp 36 shown in the accompanying drawings as being formed of resilient wire and of a generally U-shaped configuration so that one side of the clasp extends along an opposed side of the pocket and the connecting portion of the clasp joins the two sides together. Each side of the clasp is formed with a horizontal stretch 37 extending above elevated platform 28 and preferably disposed within ridges 38 thereon (see FIG. 2). At the forward end of each stretch 37 is a 180° bend so that the rearward extending stretch is disposed beneath elevated platform 28. An outward loop is formed in stretch 41 to receive fastener 43 which passes through the platform 28 and holds clasp 36 in place. Rearward extensions 44 (see FIG. 2) may extend above the top edges of supports 23 and are spaced slightly inwardly thereof. Slits 45 are formed in forward ends 26 for passage of the extensions 44. Such slits 45 are of extended width to permit flexing of stretches 44 as required. Adjacent the rearward end of each support 23, stretch 44 is formed with an outward bend 46 received in a notch 47 cut in the upper edge of support 23. Upward extending loop 48 joins the two sides of clasp 36 together. Loop 48 has on either side an inward directed stretch 49 which fits under the lower edge of channel 14, a bend 51 of about 70°, an upward-forward stretch 52 which engages the side of roller 16 and a horizontal connector 53 which fits across roller 16. Elements 53 and 54 are within channel 14. Thus, the user may insert the roller 16 between the forward end of each pocket 22 and loop 48 and then move the roller 16 rearwardly, into engagement with the loop 48. Such an arrangement accommodates different dimensions of rollers 16.

Once roller 16 is engaged in loop 48, it is desirable to resiliently hold roller 16 in position. One means for retaining rollers 16 in place is illustrated in FIGS. 1–7. Retainer 61 has a body 62, the forward end of which is bifurcated and has outward extending hinge pins 63 which are received in hinge members 64 upstanding from platform 28. Depending from body 62 is a detent 66 having barbs 67 which engage under the margin of hole 68 formed in platform 28. As shown in FIG. 5, detent 66 latches body 62 in down or solid-line position. Rearward of body 62, retainer 61 has a resilient extension 71 shaped to engage the top forward expanse of roller 16 and, at contact 72, the forward end of the toe of boot 12. Until retainer 61 is unlatched and raised to the retracted or dotted-line position shown in FIG. 5, the skate is held in pocket 22.

Figure 8:
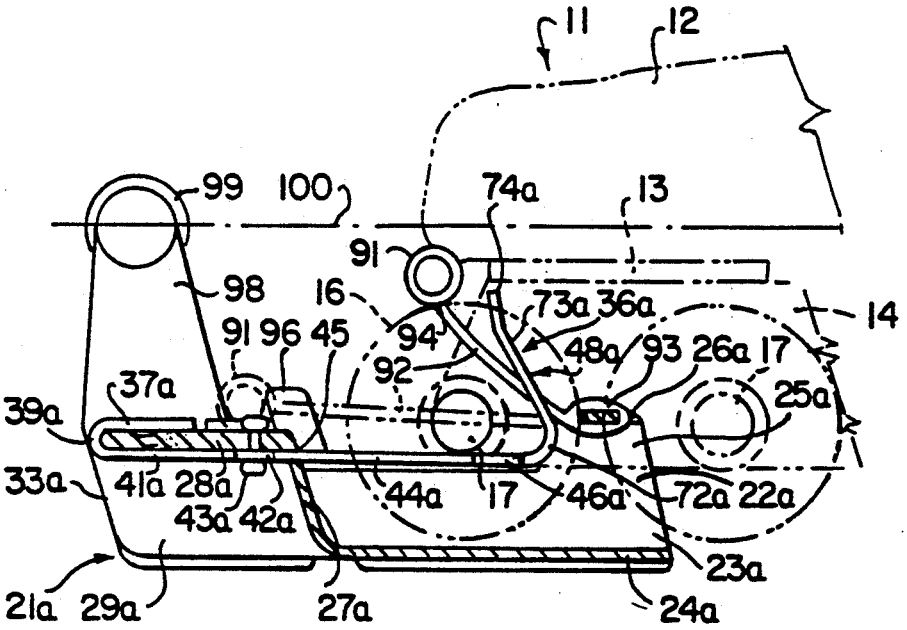
FIG. 8 is a view similar to FIG. 5 of a modification.

An alternate retainer is shown in FIG. 8. Transverse rod 91 extends a cross the fronts of both boots 12. An elastic cord 92 on either side of carrier **21*a* is provided with an attachment 93 to transverse rear connector 26*a* and by attachment 94 to rod 91. The resiliency of cord 92 biases rod 91 against the forward end of boot 12, holding roller 16 in engagement with clasp 36*a*. Retractors 96 extend upward from the forward end of each pocket to hold rod 91 in retracted position, permitting the user to remove skate 11 from pocket 22**. Other retaining means may be used.

In FIGS. 1–7 there is illustrated a handle 76 upstanding from platform 28 by which carrier 21 may be lifted and carried. The attachment of the lower end of handle 76 to platform 28 is reinforced by a gusset 77. Handle 76 is shown hollow and its upper end is closed off by a rounded top knob 78. Grip material 81 of a resilient nature may be attached to handle 76 to facilitate carrying.

Below platform 28 in line with handle 76 is a semicylindrical hanger 79 which fits over a peg or hook on a wall.

An alternate handle is shown in FIG. 8. Extending upward from either side of platform **28*a* is bracket 98. Transverse tube or rod 99 may be gripped for lifting or carrying. Handle 99 is preferably aligned with the centers of gravity of boots 12 as indicated by reference numeral 100**.

Users of skates 11 use auxiliary equipment such as knee pads, wrist guards, elbow guards and helmets and usually carry with them replacement wheels and laces and other items. The guards and helmets usually have straps which may be inserted around the handle 76 and brackets 98 or through opening 86 so that carrier 21 stores conveniently not only the skates 11 but the accessories (not shown) as well.

Figure 9:
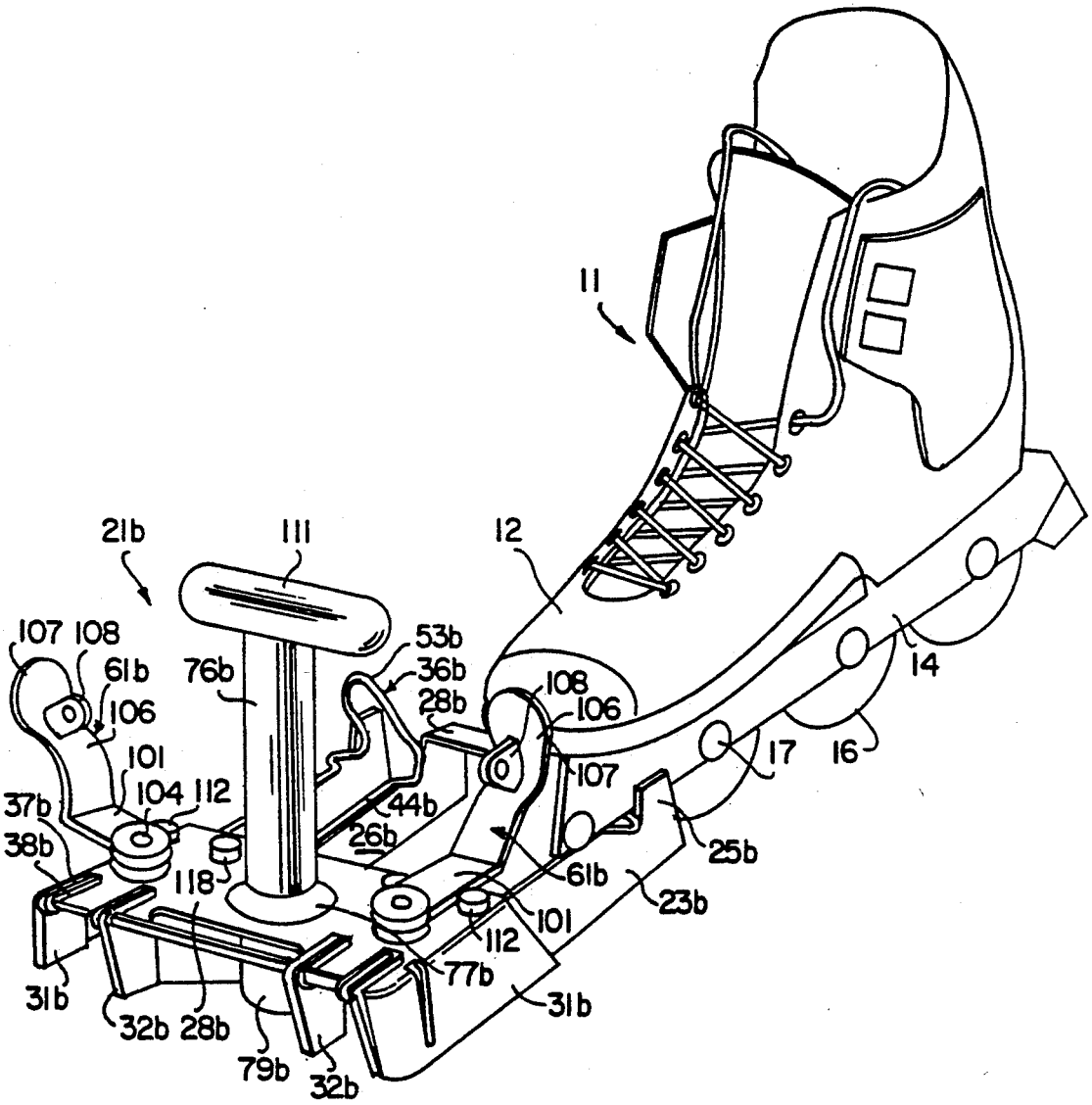
FIG. 9 is a view similar to FIG. 1 of another modification.

The modification of FIG. 9 is presently believed to be the preferred modification. Retainer **61*b* is formed of a spring material. It has a horizontal base 101, and is pivotally secured to platform 28*b* by a pin, rivet 104 or other fastener. Upward extending curved portion 106 (generally in the shape of a shallow S) is formed on the end of base 101 opposite pin 104 and is shaped so that in operative position (the right side of FIG. 9) the toe contact surface 107 pushes against the toe of boot 12 to bias the skate into engagement with clasp 36*b*. Finger grip 108 on portion 106 opposite toe contact surface 107 may be used to pivot retainer 61*b* to release position shown in the left side of FIG. 9. Stop means 112 and 113 on platform 28*b* hold base 101** in alignment.

In the modification of FIG. 9 a cross arm 111 is attached to the upper end of handle **76*b*** for more convenient gripping.

In many respects the modifications of FIGS. 8 and 9 resemble those of the preceding modification and the same reference numerals, followed by subscripts a and b, respectively are used to designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A carrier for an in-line skate of the type comprising a boot, an inverted channel depending from said boot and a plurality of rollers rotatably mounted at spaced intervals in said channel and extending below said channel, said carrier comprising a body, pocket-forming means on said body adapted to receive an end portion of said channel and at least one said roller, said pocket forming means comprising, roller-engaging means dimensioned and positioned to fit inside said channel and behind one said roller to detachably secure one said roller within said pocket-forming means.

2. A carrier according to claim 1 which further comprises second pocket-forming means on said body adapted to receive an end portion of a channel and at least one said roller of a second said skate and means interconnecting said first-mentioned pocket forming means and said second pocket-forming means to hold said pocket-forming means parallel.

3. A carrier according to claim 2 which further comprises a handle upstanding from said means interconnecting said first and second pocket-forming means.

4. A carrier according to claim 3 in which said handle is aligned with the center of gravity of said carrier when skates are held in said pocket-forming means.

5. A carrier according to claim 2 which further comprises means on said body to hang said body and the skates carried thereby from a hook on a wall.

6. A carrier according to claim 1 which further comprises resilient retaining means connected to said body and engaging said skate to bias said skate so that said one said roller is in engagement with said pocket forming means.

7. A carrier according to claim 1 which further comprises a handle connected to said body.

8. A carrier according to claim 7 in which said handle is approximately aligned with the longitudinal center line of gravity of a skate held in said pocket-forming means.

9. A carrier according to claim 1 in which said pocket-forming means comprises a channel member having a web and a pair of sides extending up from said web spaced to engage opposite sides of said inverted channel, said sides comprising said roller engaging means.

10. A carrier according to claim 1 in which said roller-engaging means comprises a generally U-shaped resilient wire member comprising a first and a second longitudinally extending stretch parallel to each other on opposite sides of said pocket-forming means, connecting means connecting each said longitudinally extending stretch to said body and an upward extending loop having a pair of sides bent upward relative to said longitudinally extending stretches and joined together by a base, said base extending alongside said inverted channel and engaging said one said roller at a position to hold said roller within said pocket-forming means.

11. A carrier according to claim 10 which said means interconnecting said first-mentioned pocket forming means and said second pocket-forming means comprises a transverse rear connector adjacent the rear of said pocket-forming means and a transverse front connector forward of said pocket-forming means, said connecting means attaching said longitudinally extending stretches to said transverse front connector.

12. A carrier according to claim 11 in which said roller-engaging means comprises a generally U-shaped resilient wire member comprising a first and a second longitudinally extending stretch parallel to each other on opposite sides of said pocket-forming means, connecting means connecting each said longitudinally extending stretch to said body and an upward extending loop having a pair of sides bent upward relative to said longitudinally extending stretches and joined together by a base, said base extending alongside said inverted channel and engaging said one said roller at a position to hold said roller within said pocket-forming means, said connecting means attaching said longitudinally extending stretches to said transverse front connector.

13. A carrier according to claim 10 in which said pocket-forming means has upper edges and said longitudinally extending stretches have rearward ends and which further comprises notches formed in said upper edges and outward bends near the rearward ends of said longitudinally extending stretches disposed in said notches to maintain said longitudinally extending stretches aligned with said pocket-forming means.

14. A carrier according to claim 1 which further comprises a resilient retainer attached to said body and engaging said skate biasing said skate to bias said one said roller into engagement with said pocket-forming means.

15. A carrier according to claim 14 in which said retainer comprises a resilient member pivotally attached to said body and movable between an operative position engaging the toe of said boot and an inoperative position.

16. A carrier according to claim 15 which further comprises a stop means to detachably hold said resilient member in operative position.

17. A carrier accordingly to claim 15 in which said resilient member comprises a base mounted on said body and a curved portion on an end of said base having a toe-engaging surface to engage said boot.

18. A carrier according to claim 14 in which said retainer comprises a retainer body, means hinging said retainer body to said carrier body, a resilient extension on said retainer body, latch means latching said retainer body to said carrier body to hold said resilient extension against said skate.

19. A carrier according to claim 18 in which said latch means comprises a detent on the underside of said retainer body and a barb on said detent, said carrier body being formed with a hole to receive said detent, said barb resiliently engaging the margin of said hole.

20. A carrier according to claim 14 in which said retainer comprises a bar extending across said pocket forming means and resilient means interconnecting said bar and said carrier body.

21. A carrier according to claim 20 which further comprises a retractor on said body to hold said retainer retracted from engagement with said skates.

22. A carrier for an in-line skate of the type comprising a boot, an inverted channel depending from said boot and a plurality of rollers rotatably mounted in said channel on axles transverse to said channel at spaced intervals in said channel, said rollers extending below said channel, said carrier comprising a body, roller-engaging means having a first end attached to said body, and a second end, said second end being dimensioned and positioned to fit inside said channel and to engage one said roller at at least one point remote from said body and on a side of said axle remote from said body to hold said skate suspended from said body when said body is positioned elevated above said skate.

23. A carrier according to claim 22 in which said second end is shaped as a hook in side elevation.

24. A carrier according to claim 22 which further comprises means on said roller-engaging means to engage said channel to restrain rotation of said skate about said axle.

25. A carrier according to claim 22 which further comprises a pocket-forming means on said body having a web and sides engaging opposite sides of said channel, said roller-engaging means engaging said pocket-forming means.

26. A carrier according to claim 25 in which said second end of said roller-engaging means is generally U-shaped and extends into said channel.

27. A carrier according to claim 26 in which said pocket-forming means has upper edges and which further comprises notches formed in said upper edges and said roller-engaging means has outward projections disposed in said notches.

* * * * *